US005372000A

United States Patent [19]

Altermatt et al.

[11] Patent Number: 5,372,000

[45] Date of Patent: Dec. 13, 1994

[54] APPARATUS FOR FILLING FLEXIBLE BAGS

[75] Inventors: Willy Altermatt, Neuhausen am Rheinfall; Georg Kopp, Uhwiesen, both of Switzerland

[73] Assignee: SIG Schweizerische Industrie-Gesellschaft, Neuhausen am Rheinfall, Switzerland

[21] Appl. No.: 56,749

[22] Filed: May 4, 1993

[30] Foreign Application Priority Data

May 6, 1992 [CH] Switzerland ..... 01450/92

[51] Int. Cl.[5] ..... B65B 43/30; B65B 43/32

[52] U.S. Cl. ..... 53/570; 53/373.2; 53/373.5; 53/469; 53/481; 53/574

[58] Field of Search ..... 53/285, 373.2, 373.5, 53/373.7, 467, 468, 469, 479, 481, 516, 570, 574, 373.4

[56] References Cited

U.S. PATENT DOCUMENTS

| | | | |
|---|---|---|---|
| 2,702,150 | 2/1955 | Vogt | 53/570 |
| 3,306,002 | 2/1967 | Vogt | 53/481 |
| 3,382,644 | 5/1968 | Vogt | 53/469 |
| 4,249,361 | 2/1981 | Tetenborg et al. | 53/469 |
| 4,353,198 | 10/1982 | Koppe | 53/570 |
| 4,756,142 | 7/1989 | Tetenborg | 53/481 |
| 4,977,728 | 12/1990 | Rambold | 53/570 |

FOREIGN PATENT DOCUMENTS

| | | |
|---|---|---|
| 711406 | 10/1941 | Germany . |
| 2225368 | 12/1972 | Germany . |
| 410752 | 10/1966 | Switzerland . |
| 444658 | 3/1936 | United Kingdom . |

*Primary Examiner*—W. Donald Bray

*Attorney, Agent, or Firm*—Spencer, Frank & Schneider

[57] ABSTRACT

An apparatus for filling flexible bags includes an endless conveyor having a generally horizontally oriented upper run; and a plurality of bag holders mounted on the conveyor and distributed therealong. Each bag holder includes two cooperating plates extending upwardly from the upper (working) run of the conveyor and movable towards and away from one another. The apparatus further includes a bag supplying device situated along the conveyor for introducing an empty bag between the plates of the bag holder momentarily in alignment with the bag supplying device; a filling device situated above the upper run for sequentially charging the bags with contents; a sealing device situated downstream of the filling device for sealing an open end of the bag; a discharging device situated downstream of the sealing device for releasing the bag from the holder; and a driving mechanism for moving the plates into a spread-apart position at the bag supplying device, the filling device and the discharging device and for moving the plates towards one another into a closed position at the sealing device.

10 Claims, 5 Drawing Sheets

1
2
3
4
5
6
7
8
9
10
12
13
14
15
16
17
18
21
22
23
24
25
26
37
38
39
A
II
II

APPARATUS FOR FILLING FLEXIBLE BAGS

CROSS REFERENCE TO RELATED APPLICATION

This application claims the priority of Swiss Application No. 1450/92-2 filed May 6, 1992, which is incorporated herein by reference.

BACKGROUND OF THE INVENTION

This invention relates to an apparatus for charging flexible bags with flowable material, for example, with flowable confectionery items.

German Offenlegungsschrift (application published without examination) 2 225 368 describes an apparatus for making and filling bags. The charging apparatus has two parallel, intermittently advanced circulating chains on which a series of upstanding, pliers-like clamps are mounted. The bag is pushed horizontally between the two jaws of one of the opened clamps. The bags are horizontally advanced in sequence into the open jaws of a clamp momentarily disposed at a bag supplying station. Thereafter the clamp closes to hold the bag and to carry it to a station in which the bag is opened by suction grippers. The bag is filled in adjoining filling stations and thereafter sealed and removed for further package processing. This prior art apparatus has the disadvantage that it is of complex construction and accordingly, it is expensive to make and service.

SUMMARY OF THE INVENTION

It is an object of the invention to provide an improved apparatus of the above-outlined type which is simple to manufacture and to service.

These objects and others to become apparent as the specification progresses, are accomplished by the invention, according to which, briefly stated, the apparatus for filling flexible bags includes an endless conveyor having a generally horizontally oriented upper run; and a plurality of bag holders mounted on the conveyor and distributed therealong. Each bag holder includes two cooperating plates extending upwardly from the upper (working) run of the conveyor and movable towards and away from one another. The apparatus further includes a bag supplying device situated along the conveyor for introducing an empty bag between the plates of the bag holder momentarily in alignment with the bag supplying device; a filling device situated above the upper run for sequentially charging the bags with contents; a sealing device situated downstream of the filling device for sealing an open end of the bag; a discharging device situated downstream of the sealing device for releasing the bag from the holder; and a driving mechanism for moving the plates into a spread-apart position at the bag supplying device, the filling device and the discharging device and for moving the plates towards one another into a closed position at the sealing device.

DESCRIPTION OF THE PREFERRED EMBODIMENT

Figure 1:
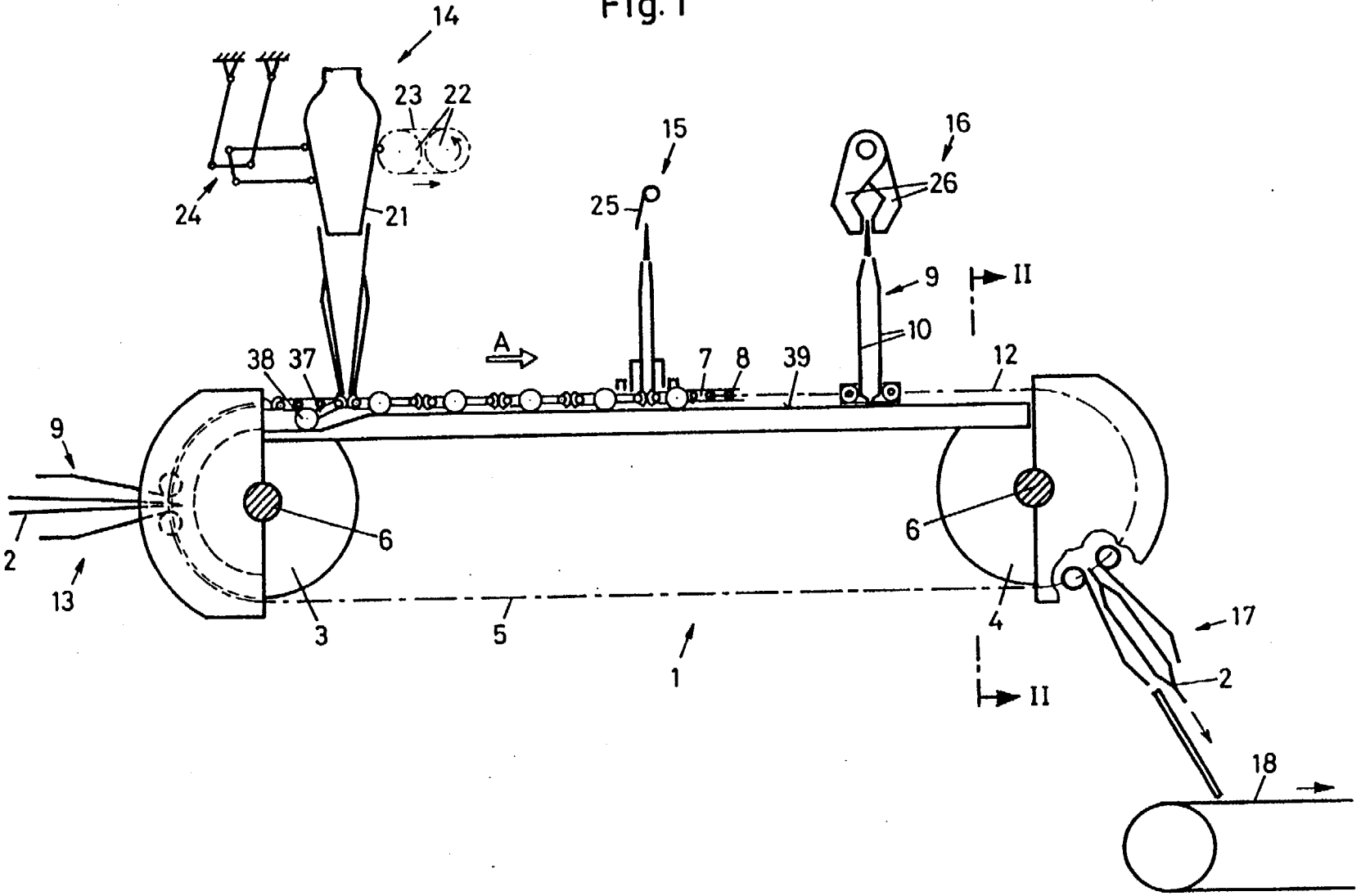
FIG. 1 is a schematic side elevational view of the apparatus according to a preferred embodiment of the invention.
Figure 2:
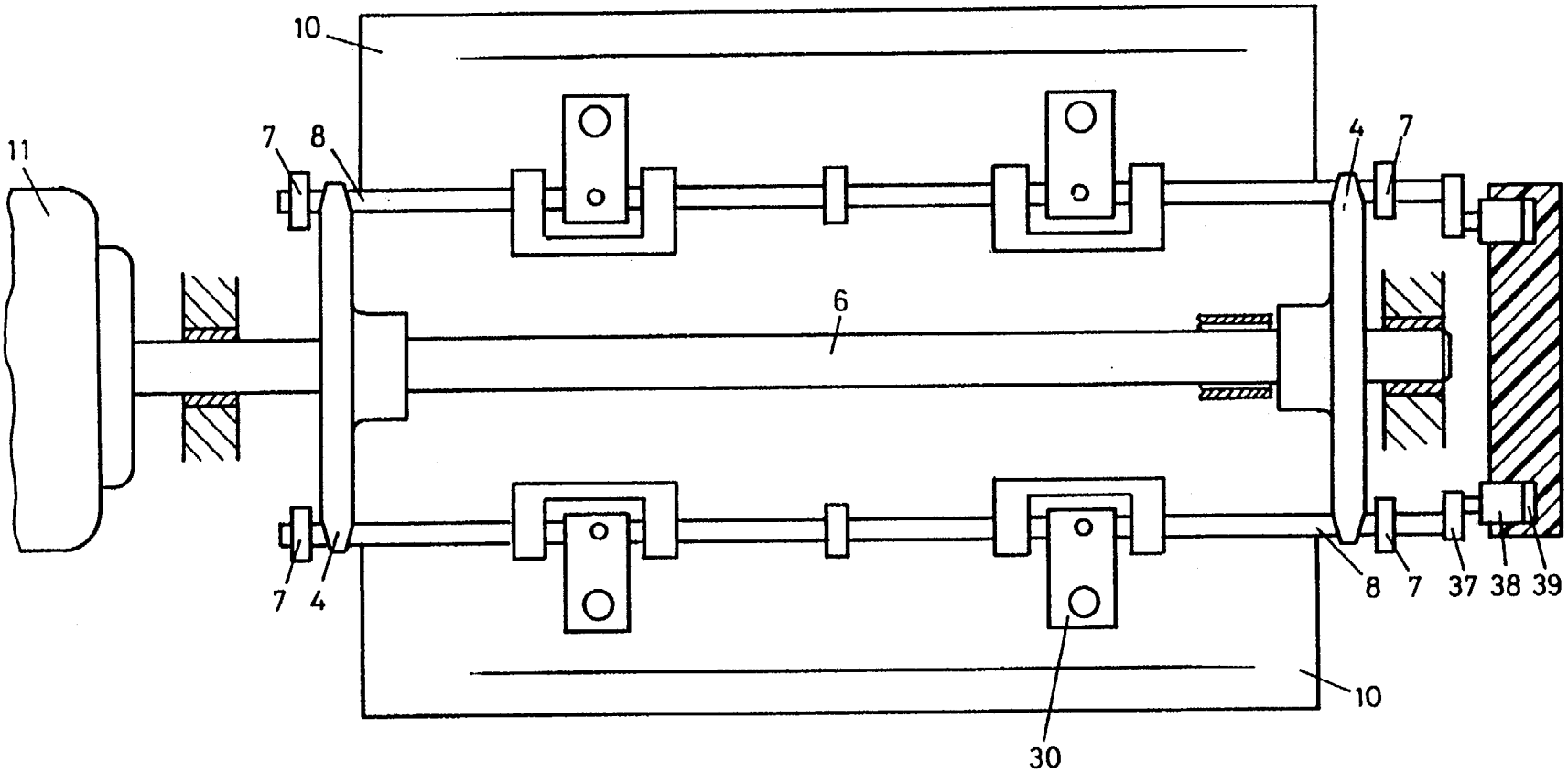
FIG. 2 is a sectional view taken along line II—II of FIG. 1.

Turning to FIGS. 1 and 2, there is illustrated therein an apparatus generally designated at 1 for charging flexible, flat, plastic film bags 2 with foodstuff, such as, for example, flowable confectionery items. The bags 2 are, from a non-illustrated, upstream-arranged bag-making machine, simultaneously advanced cyclically in a horizontal, side-by-side orientation.

The apparatus has two rear and two front chain sprockets 3 and 4 mounted on respective common shafts 6, one of which is rotated by a motor 11. The sprockets 3 and 4 support two parallel chains 6 which are continuously circulated in a direction A. The two chains are formed of chain links 7 and common transverse carrier shafts 8 about which adjoining links 7 may pivot. The shafts 8 extend transversely between the two chains 5, perpendicularly to the direction A. The shafts 8 form shaft pairs, each composed of two adjoining shafts 8. On each shaft pair an outwardly extending bag holder 9 is provided, each including two plates 10. For better visibility, FIG. 1 shows only five holders 9.

Approximately in the horizontal plane of the axes of the shafts 6, at the sprockets 3 a bag-supplying station 13 is arranged which pushes bags 2 into the momentarily aligned, opened holder 9. Above the upper, horizontal run 12 of the chains 5 a charging station 14, a bag smoothening station 15 and a sealing station 16 are serially arranged. A discharging station 17 is situated at the sprockets 4 where the filled and sealed bags may be placed, for example, onto a removal conveyor belt 18.

The charging station 14 is formed of a plurality of side-by-side arranged charging hoppers 21 (only one is visible in FIG. 1) which, during the charging process, are co-travelling with the chains 5. For this purpose each hopper 21 may be attached to a chain 23 which circulates synchronously with the chains 5 about two sprockets 22. The machine frame further supports a parallelogram guide 24 to which the hoppers 21 are secured and which ensures the upright orientation thereof. Non-illustrated dosing devices are provided for charging the bags with flowable material through the hoppers 21. The sealing shoes 26 of the sealing station 16 co-travel with the chains 5 during the sealing process, for example, by means of a mechanism identical to that which moves the hoppers 21 parallel to the direction A. The smoothening station is essentially formed by a pivotal swiping blade 25.

Figure 3:
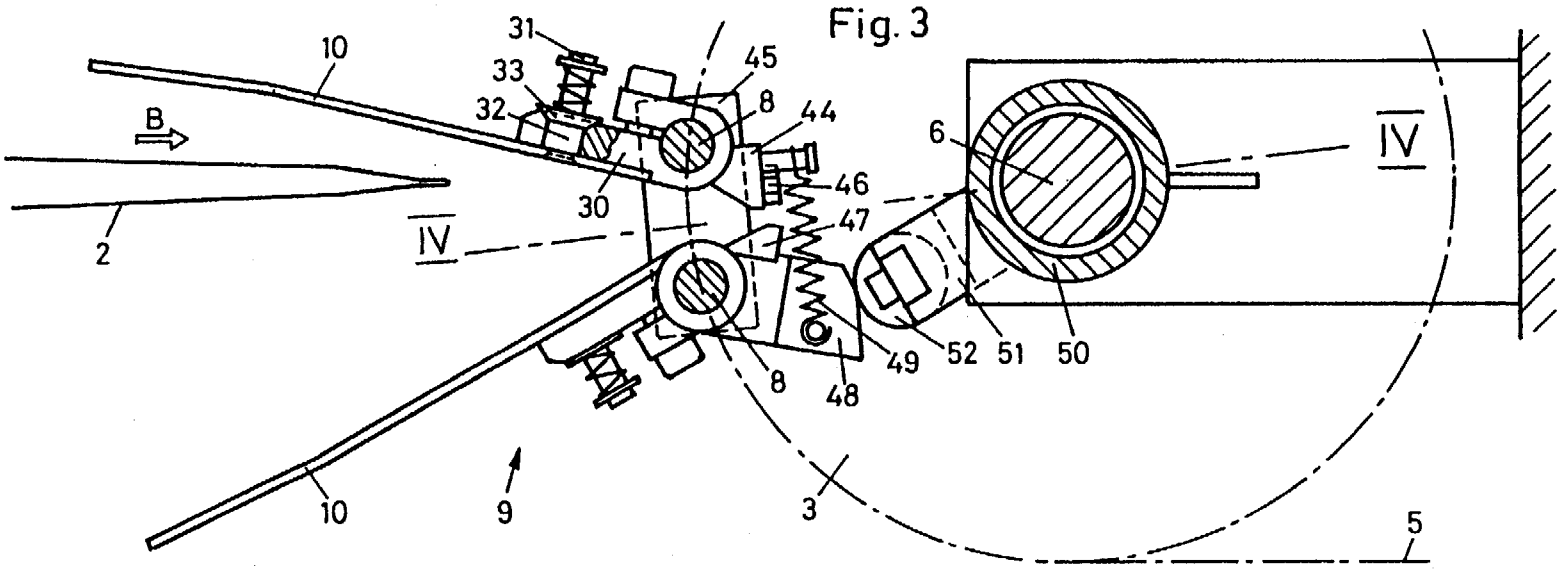
FIG. 3 is an enlarged sectional side elevational detail of the structure shown in FIG. 1.
Figure 4:
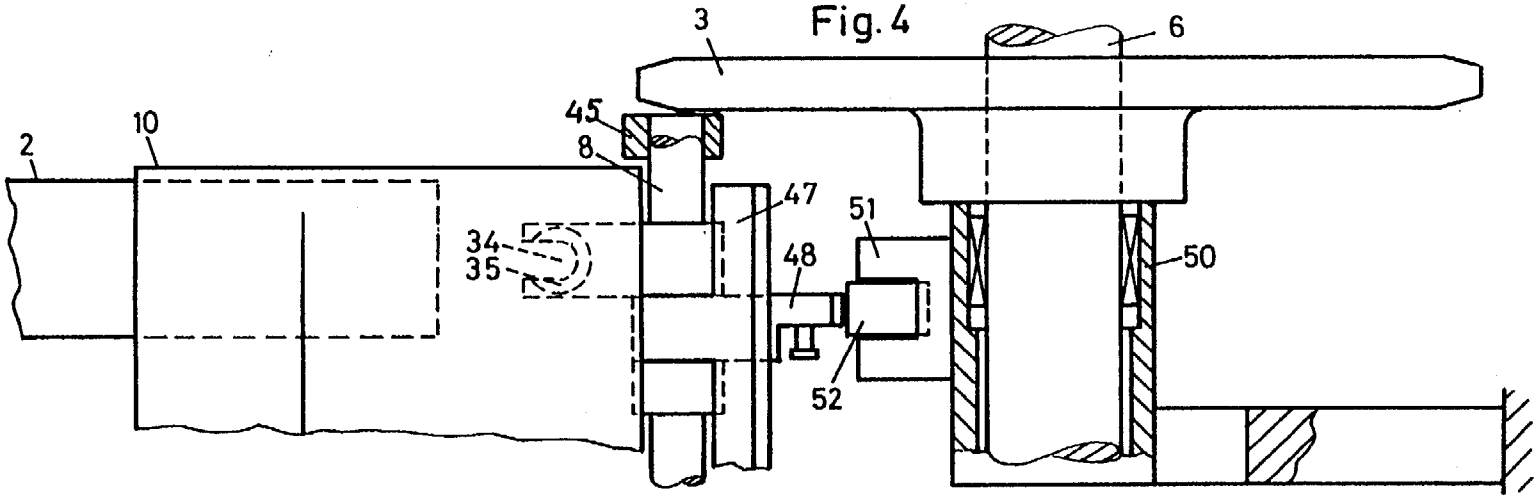
FIG. 4 is a sectional view taken along line IV—IV of FIG. 3.

With particular reference to FIGS. 3 and 4, on shafts 8 carriers 30 are affixed by screws. The plates 10 are readily replaceably secured to the carriers 30 so that a conversion of the apparatus 1 for different bag configurations may be effected simply and rapidly. For this purpose, bolts 31 are riveted to the plates 10 and on the bolts 31 spring-biased sleeves 32 having a conical flange 33 are inserted. Each sleeve 32 extends into a slot 34 and each flange 33 extends into a conical depression 35 provided in the respective carrier 30.

Figure 5:
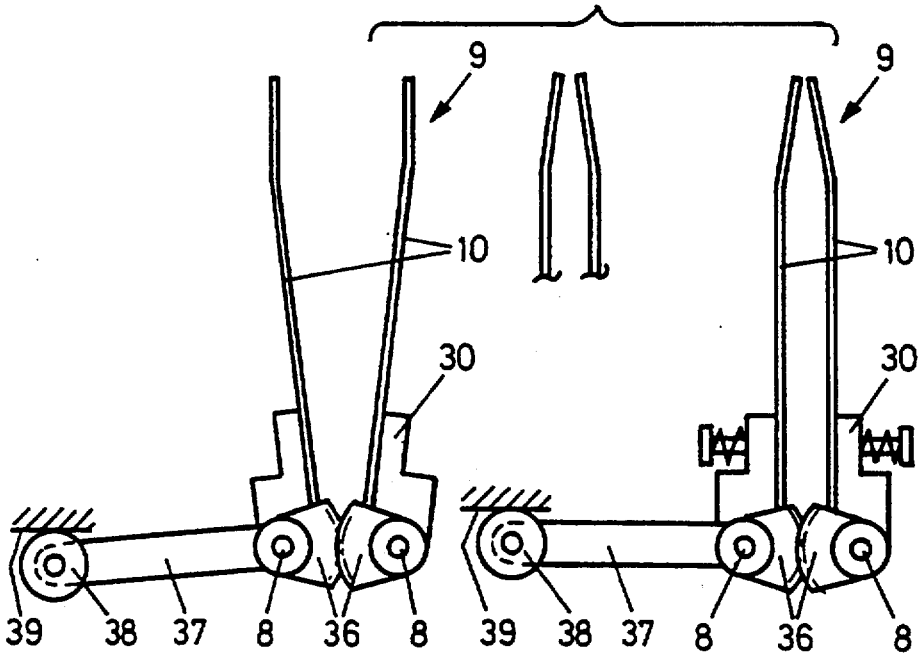
FIG. 5 is a schematic side elevational view of a further detail of FIG. 1.
Figure 6:
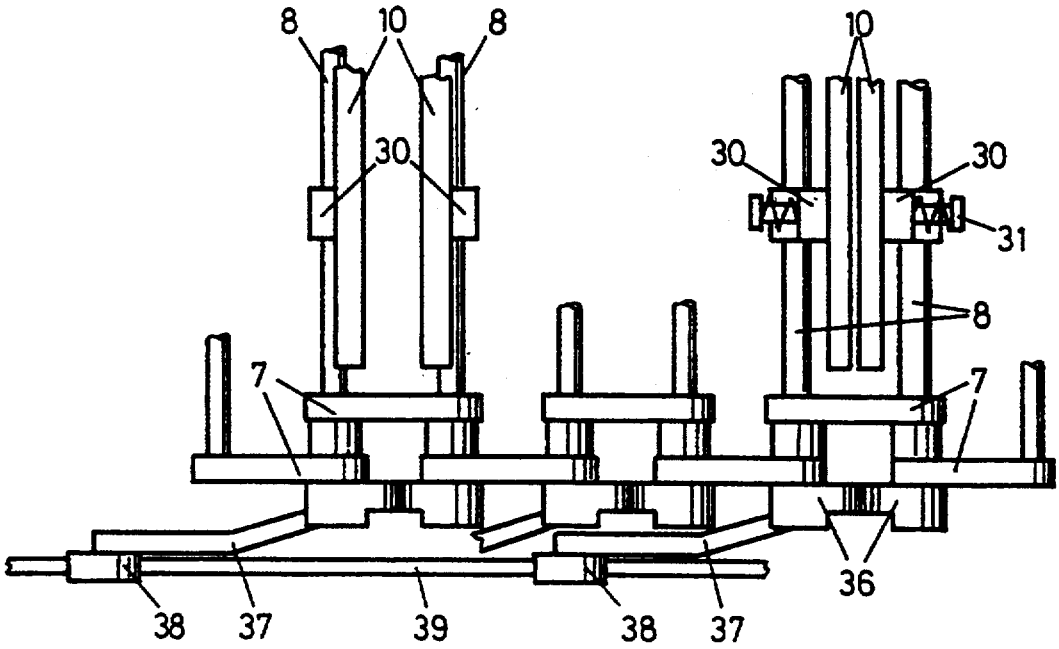
FIG. 6 is a top plan view of the construction shown in FIG. 5.

FIGS. 5 and 6 show schematically the drive for opening and closing plates 10 of each holder 9. The two shafts 8 of the holder 9 are connected to one another by means of toothed segments 36 to ensure a simultaneous, oppositely oriented rotation of the two shafts 8. To one of the shafts 8 an outwardly extending lever 37 is affixed which, at its other end, carries a roller 38 guided in a cam track 39.

As shown in FIGS. 3 and 4, the two shafts 8 of the holder 9 are connected to one another by means of several shackles 45. A throughgoing first bag-clamping shoe 44 is affixed by screws 46 to the shackles 45 adjacent the leading shaft 8. A plurality of second bag-clamping shoes 47 are pivotally supported on the trailing shaft 8. An arm 48 is connected with the bag-clamping shoes 47. The shaft 6 carrying the chain sprockets 3 is rotatably supported in a stationary tube 50 to which a plurality of radially extending arms 51 are welded which carry rollers 52 at their free ends. Immediately in front of the bag supply station 13 the arms 48 run up the rollers 52 and lift the bag-clamping shoes 47 off the bag-clamping shoe 44 so that the already-sealed leading edge of the bag 2 may be pushed between the spaced-apart clamping shoes 44, 47. As the clamping shoes 44, 47 leave the bag supply station 13, the clamping shoes 44, 47 close by virtue of the force exerted by respective spring 49 and firmly hold (clamp) the bag 2 at its edge which is opposite the bag opening through which the filling of the bag is to take place.

The guide track 39 is so designed that the two plates 10 of the holder 9 are slightly closed between the bag supply station 13 and the filling station 14. Thus, the course of the guide track 39 is such that the plates 10 are spread apart to a greater extent at the bag supply station 13 and at the discharging station 17 than at the filling station 14. In order to maintain the bags 2 in an optimally open position at the filling station 14, it is expedient to provide two lateral guide plates at each of the plurality of laterally side-by-side extending bag rows on the top, externally of the free ends of the plates 10. The guide plates slightly converge towards the filling station 14. After charging the bags, the holders 9 are, by virtue of the course of the guide track 39, slowly closed to prevent lightweight contents from being blown out of the filled bags.

Figure 7:
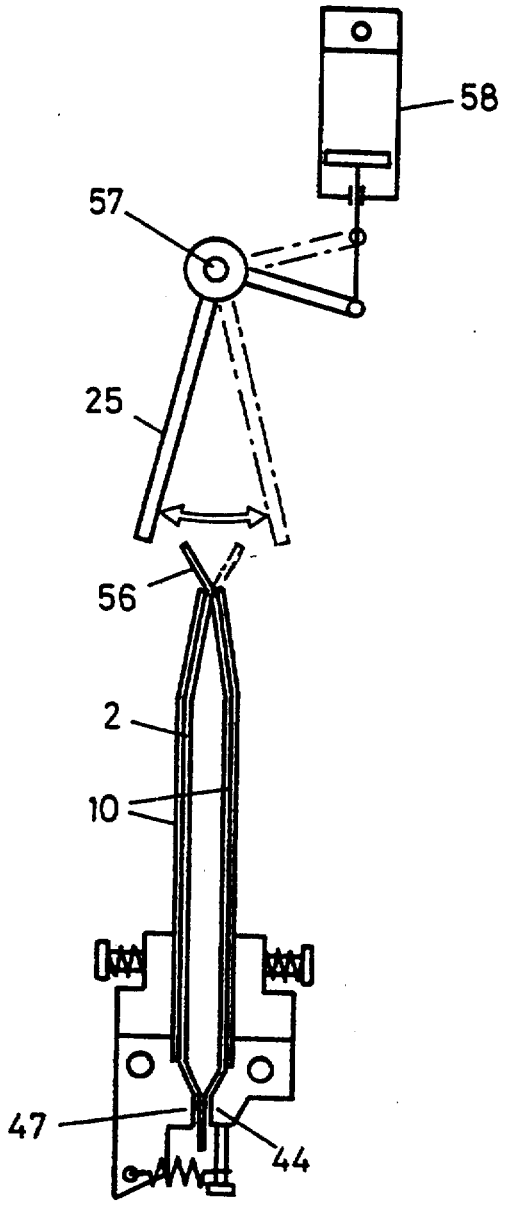
FIG. 7 is a schematic side elevational view of a further detail of the construction shown in FIG. 1.

To obtain a wrinkle-free sealing seam, it is expedient to smoothen the edge 56 of the bags 2 projecting beyond the plates 10 before the bag reaches the sealing station 16. For this purpose, a smoothening blade 25 is provided (illustrated in detail in FIG. 7) which is oscillated back and forth about a shaft 57 by means of a pneumatic cylinder 58 to cause the edge 56 of the bag to be pivoted about the edges of the plates 10. Thereafter, the bag arrives in the sealing station 16 where a transverse closing seal is provided by the sealing shoes 26.

At the bag discharging station 17 the clamping shoes 44, 47 are opened in the same manner as at the bag supply station 13. Further, by means of the guide track 39, the two plates 10 of each holder 9 are spread apart. By virtue of these operations the filled and sealed bag is released from the apparatus 1 and falls, for example, on the removal conveyor belt 18.

The above-described apparatus is of simple and compact construction and may thus be manufactured in an economical and simple manner. The bags 2 are moved past the filling station 14 in an orientation which is perpendicular to their broad side. In this manner, the bags may follow very closely one another which results in a short structural length of the apparatus. Thus, with a relatively low, constant circulating speed of the chains 5, a high packaging output may be achieved.

As a departure from the illustrated embodiment, the bag supply station 13 may be arranged further up along the sprockets 3 or may be arranged vertically above the horizontal, upper chain run 12. In such a case the clamping shoes 44 and their actuating mechanism may be omitted or may be replaced, for example, by U-shaped rails which function as an abutment. Dependent upon the manner in which the empty bags are supplied, it may be expedient to provide a stationary abutment behind the stationary clamping shoe 44. Since the filling station 14, the bag edge smoothening station 15 and the sealing station 16 are all arranged above the horizontal run 12, they are expediently mounted on a common height-adjustable carrier. It is an advantage of such an arrangement that the apparatus may be settable very rapidly to adapt to other bag configurations by adjusting the carrier to the required height and replacing the plates 10.

The two plates 10 of each holder 9 are at their free ends bent towards one another at an obtuse angle. By virtue of this measure, upon closing the holder 9 prior to reaching the sealing station 16, the free bag end is optimally prepared for the sealing process. Because the two plates 10 of each holder 9 support the entire large surfaces of the bags 2, the bag may be optimally charged. In this manner the amount of packaging material for any given content volume may be minimized.

It will be understood that the above description of the present invention is susceptible to various modifications, changes and adaptations, and the same are intended to be comprehended within the meaning and range of equivalents of the appended claims.

What is claimed is:

1. An apparatus for filling flexible bags, comprising (a) an endless conveying member having a generally horizontally oriented upper run;

(b) supporting means for supporting said endless conveying member;

(c) first drive means for circulating said endless conveying member to move said upper run in a direction of advance;

(d) a plurality of bag holders mounted on said endless conveying member and distributed therealong; each bag holder including two cooperating plates disposed side by side transversely to said direction of advance and movable towards and away from one another; said plates extending upwardly from said upper run;

(e) a bag supplying means situated along said endless conveying member for introducing an empty bag between the plates of the bag holder momentarily in alignment with said bag supplying means;

(f) filling means situated above said upper run for sequentially charging the bags with contents;

(g) sealing means situated downstream of said filling means as viewed in said direction of advance for sealing an open end of the bag;

(h) discharging means situated downstream of said sealing means for releasing the bag from the holder; and (i) second drive means for moving said plates into a spread-apart position at said bag supplying means, said filling means and said discharging means and for moving said plates towards one another into a closed position at said sealing means.

2. The apparatus as defined in claim 1, each holder further comprising two cooperating clamping shoes and means for urging said clamping shoes towards one another for clamping therebetween a bag along a bag edge; further comprising releasing means at said bag supplying means and said discharging means for spreading said clamping shoes apart at said bag supplying means and said discharging means.

3. The apparatus as defined in claim 1, wherein said endless conveying member comprises two parallel-spaced chains trained about respective end sprockets mounted on two parallel-spaced sprocket shafts extending transversely to said direction of advance; said endless conveying member further comprising a plurality of spaced carrier shafts oriented transversely to said direction of advance and each connecting the two chains with one another; further wherein the two plates of each said holder are pivotally mounted on adjoining two carrier shafts; one of the adjoining carrier shafts being a leading carrier shaft as viewed in said direction of advance and one of said adjoining carrier shafts being a trailing carrier shaft.

4. The apparatus as defined in claim 2, wherein said endless conveying member comprises two parallel-spaced chains trained about respective end sprockets mounted on two parallel-spaced sprocket shafts extending transversely to said direction of advance; said endless conveying member further comprising a plurality of spaced carrier shafts oriented transversely to said direction of advance and each connecting the two chains with one another; further wherein the two plates of each said holder are pivotally mounted on adjoining two carrier shafts; one of the adjoining carrier shafts being a leading carrier shaft as viewed in said direction of advance and one of said adjoining carrier shafts being a trailing carrier shaft; further wherein one of said clamping shoes is a leading clamping shoe as viewed in said direction of advance and one of said clamping shoes is a trailing clamping shoe; further comprising a shackle connecting said leading and trailing carrier shafts to one another; said leading clamping shoe being affixed to said shackle adjacent said leading carrier shaft and said trailing clamping shoe being pivotally mounted on said trailing carrier shaft.

5. The apparatus as defined in claim 3, further comprising releasable securing means for replaceably mounting each said plate to respective said carrier shafts.

6. The apparatus as defined in claim 1, wherein each said plate is bent at an obtuse angle to form an angled end portion remote from said endless conveying member; said end portions of two adjoining plates belonging to a common said holder are bent towards one another; wherein in said closed position said plates are at a greater distance from one another than said end portions.

7. The apparatus as defined in claim 1, further comprising bag-smoothening means situated upstream of said sealing means for smoothening a bag edge projecting beyond said plates as said holder carrier the bag towards said sealing means.

8. The apparatus as defined in claim 1, wherein said second drive means includes means for spreading the plates apart to a greater extent at said bag supplying means and at said discharging means than at said filling means.

9. The apparatus as defined in claim 1, said sealing means comprising sealing shoes and means for causing said sealing shoes to travel synchronously with said endless conveying member during sealing of the bag by said sealing means.

10. The apparatus as defined in claim 1, said filling means comprising a hopper and means for causing said hopper to travel synchronously with said endless conveying means during filling of the bag by said filling means.

* * * * *